US007104054B1

(12) United States Patent
Dix

(10) Patent No.: US 7,104,054 B1
(45) Date of Patent: Sep. 12, 2006

(54) HYDRAULIC CYLINDER CUSHIONING

(75) Inventor: Peter J. Dix, Naperville, IL (US)

(73) Assignee: CNH America LLC, New Holland, PA (US)

( * ) Notice: Subject to any disclaimer, the term of this patent is extended or adjusted under 35 U.S.C. 154(b) by 0 days.

(21) Appl. No.: 11/099,298

(22) Filed: Apr. 5, 2005

(51) Int. Cl.
*F15B 13/044* (2006.01)

(52) U.S. Cl. ..... 60/459; 60/469

(58) Field of Classification Search ..... 60/459, 60/469; 91/358 R, 405, 459
See application file for complete search history.

(56) References Cited

U.S. PATENT DOCUMENTS 4,864,746 A 9/1989 Fukumoto
4,964,779 A * 10/1990 Sagaser ..... 414/708
5,025,626 A 6/1991 Crosser et al.
5,442,868 A 8/1995 Ahn
5,513,551 A * 5/1996 Morishita ..... 91/459
5,572,809 A 11/1996 Steenwyk et al.
5,903,988 A 5/1999 Tochizawa et al.
6,474,064 B1 11/2002 Heyne et al.
6,572,738 B1 6/2003 Zueger
6,618,967 B1 9/2003 Satzler et al.
6,647,721 B1 11/2003 Heyne et al.
2002/0038548 A1 4/2002 Sharkness et al.
2003/0056405 A1 3/2003 Sharkness et al.
2003/0084663 A1 5/2003 Heyne et al.
2003/0226292 A1 12/2003 Sharkness et al.
2003/0230010 A1 12/2003 Sharkness et al.
2004/0045289 A1 3/2004 Ikeda et al.

* cited by examiner

*Primary Examiner*—Thomas E. Lazo
(74) *Attorney, Agent, or Firm*—Stephen A. Bucchianeri; John William Stader; Michael C. Harms

(57) ABSTRACT

A system for damping the extension and retraction of a hydraulic cylinder of a work vehicle at the ends of the cylinder's stroke.

19 Claims, 3 Drawing Sheets

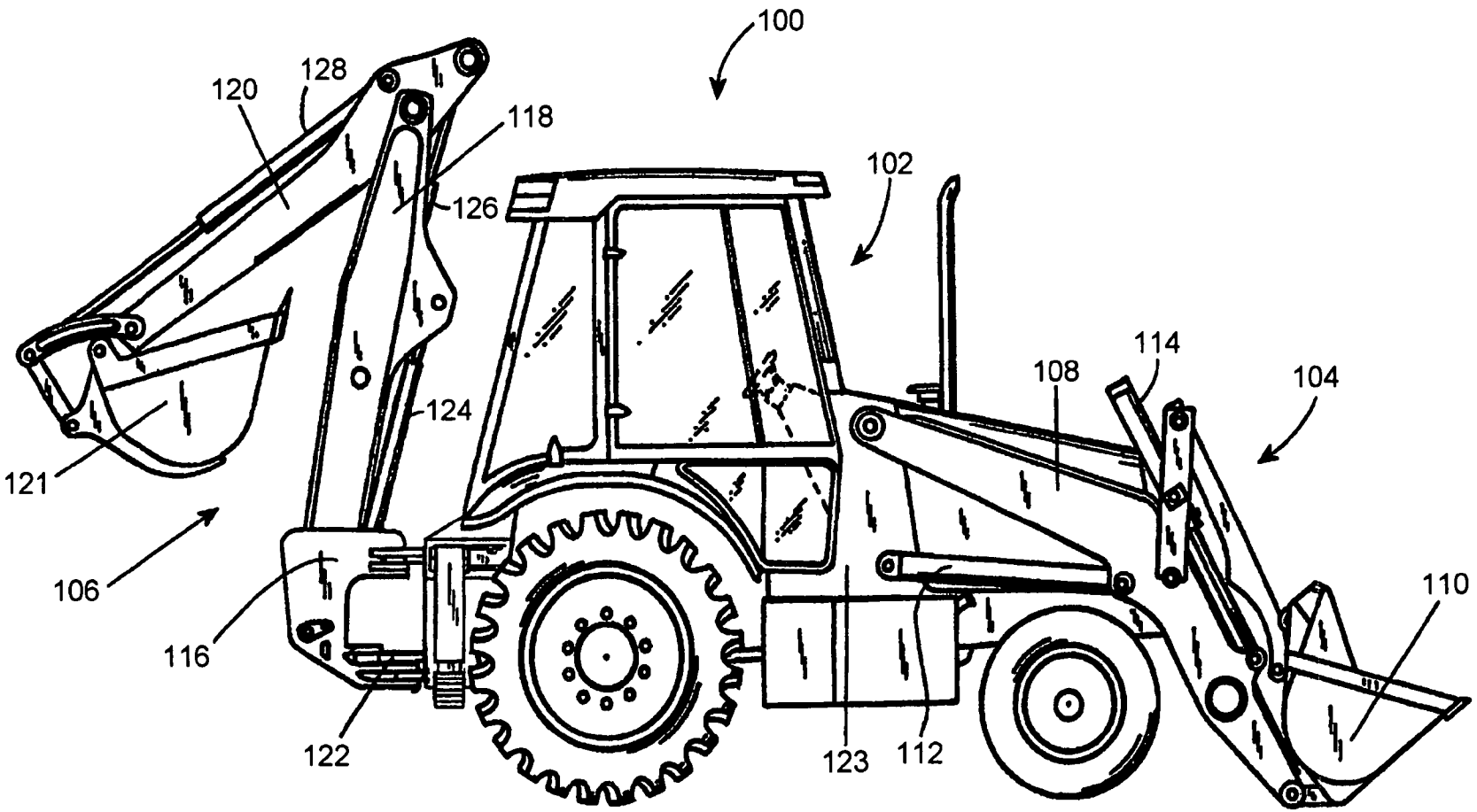
Fig. 1
Replacement Sheet

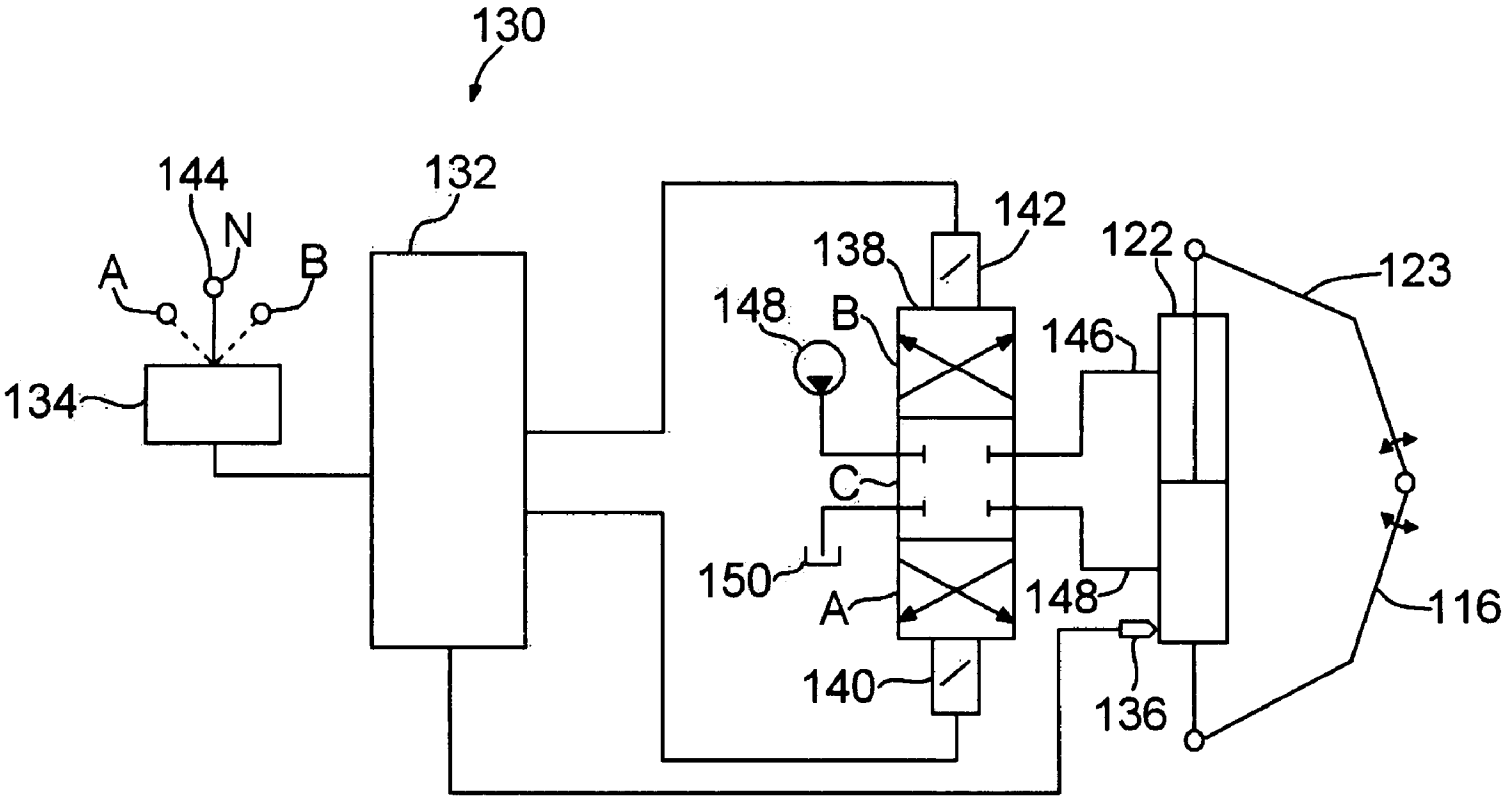
Fig. 2
Replacement Sheet

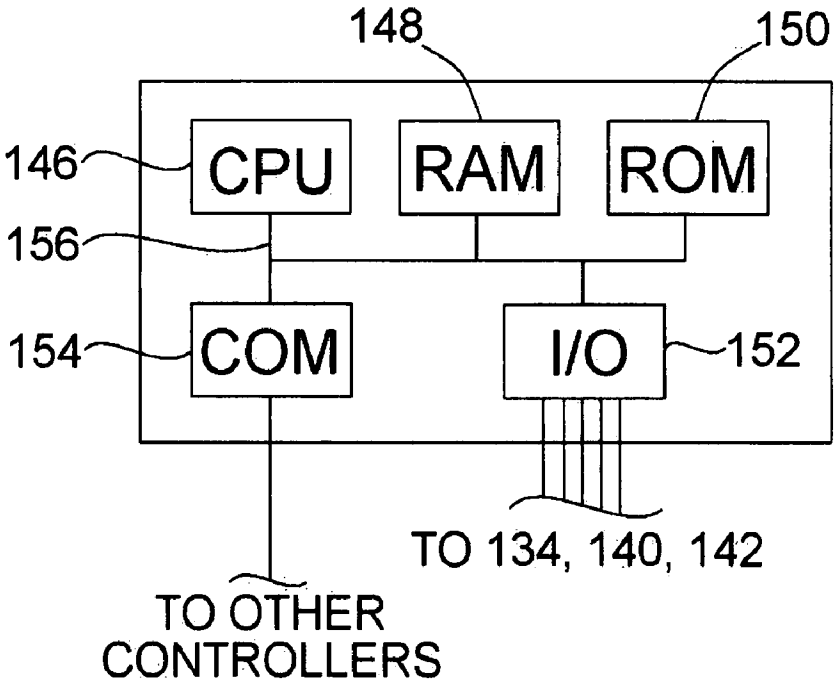
Fig. 3
Replacement Sheet

HYDRAULIC CYLINDER CUSHIONING

FIELD OF THE INVENTION

The invention relates generally to hydraulic cylinders used to move implements on a work vehicle. More particularly, it relates to automatic control systems for extending and retracting these cylinders. Even more particularly, it relates to control systems for damping and undamping the movement of hydraulic cylinders in response to operator commands.

BACKGROUND OF THE INVENTION

Hydraulic cylinders are the most common actuator used on work vehicles to swing backhoe booms, raise and lower booms and dippers, articulate vehicles, raise buckets, tilt buckets, extend and retract stabilizers and a variety of other tasks.

Hydraulic cylinders are subject to extreme forces. The operating pressures in hydraulic cylinders can easily reach 1500 pounds per square inch. These pressures are large enough to permit the cylinders to move the devices to which they are coupled at great speed. Often, the speeds are great enough that the vehicle can be damaged over time. Further, the noise of impact can be excessive as the various component bang into each other.

Reaching a "stop" in this context means reaching the greatest possible extension or retraction of the cylinder itself, whether that extension or retraction is stop by structures within the cylinder, or structures to which the cylinder is coupled.

To reduce this potential damage, hydraulic cylinders have been coupled to mechanical and electrical devices that decelerate the cylinder reducing its speed of movement as the cylinder approaches one of its two stop positions. Mechanical devices include such things as self-contained hydraulic dampers or resilient shock absorbers that engage the cylinder (or more typically, a mechanical linkage coupled to the cylinder) in the last few centimeters of travel. The advantage to mechanical devices is that they are simple and robust.

Electrical devices have also been devised to decelerate the cylinder as it approaches a stop position. These systems typically include an electrical circuit coupled to a valve that controls the flow of hydraulic fluid to the cylinder. The circuit senses the position of the cylinder and throttles the flow of hydraulic fluid to the cylinder as the cylinder approaches a stop. One example of the circuit like this is shown in US patent application publication 2004/0045289 A1.

In the '289 reference, a controller 40 is coupled to a valve 35 which controls the flow of fluid to a cylinder 17. Controller 40 is also coupled to a sensor 20 that indicates the position of a swing angle of a working machine—in this case an excavator. When the operator swings the excavator boom, the sensor senses that the boom is approaching a limit of movement (i.e. approaching a stop). Controller 40 throttles the valve controlling fluid flow to cylinder 17. This reduction in flow decelerates the rate the cylinder extends or and slows the cylinder and excavator boom to a halt just as the boom and cylinder reach the stop.

Drawbacks of both the mechanical and electrical systems are that they cannot be easily and temporarily turned off—they always damp the movement of the hydraulic cylinder. The operator occasionally prefers to "bump" the implement against its stop, bringing the implement to a sudden halt.

Such bumping is useful to empty an implement bucket having sticky material, or to shake dirt off the implement itself. If the hydraulic cylinder is only capable of smoothly decelerating a bucket without any sudden impact, the operator will never be able to empty the bucket or dislodge the earth.

What is needed, therefore, is an arrangement for turning off cylinder damping or cushioning in order to provide a sudden halt against a stop. What is also needed is a system for selectively permitting an implement to make sudden halt against a stop in one mode of operation and to make a gentle cushion stop in a second mode of operation. What is also needed is a system to select between these two modes of operation. What is further needed is a system for automatically selecting between these modes of operation requiring little if any operator intervention. What is also needed is a system for selecting one of these modes using the operator input device that also commands the movement of the cylinder. It is an object of this invention to provide such a system.

SUMMARY OF THE INVENTION

In accordance with a first aspect of the invention, a system for damping the extension and retraction of a hydraulic cylinder of the work vehicle at the ends of the cylinder's stroke is provided, the system including: a manually operable operator input device configured to generate a command signal indicative of desired cylinder movement direction and cylinder movement rate over the cylinder's entire range of motion; a hydraulic cylinder having a retraction limit position and an extension limit position; a sensor configured to generate a signal indicative of hydraulic cylinder position; a valve coupled to the cylinder to control flow rate of hydraulic fluid to and from the cylinder; and an electronic controller that is coupled to the operator input device to receive the input device signal, that is coupled to the sensor to receive the sensor signal, and that is coupled to the valve to command valve opening and closing; wherein the controller is configured to (1) damp retraction of the cylinder near its retraction limit position, (2) damp extension of the cylinder near its extension limit position, and (3) automatically stop damping retraction and extension upon receipt of a damping cancellation signal from the input device.

The operator input device may include a member having a central neutral position that can be deflected into directions away from the neutral position. The damping cancellation signal from the input device may be a function of at least two specific and successive movements of the input device occurring within a predetermined period of time. The controller may maintain an internal timer indicating the time between the occurrence of the at least two specific and successive movements. A first movement of the two movements may be a first reversal of an operator command and a second movement of the two movements may be a second reversal of an operator command. The cylinder may have a central range of positions between the extension limit position and the retraction limit position in which the damping cancellation signal provided by the input device does not cancel damping.

In accordance with a second aspect of the invention, a system is provided for damping the extension and retraction of a hydraulic cylinder of the work vehicle at the ends of the cylinder's stroke, the system comprising means for generating a command signal indicative of desired cylinder movement direction and rate over the cylinder's entire range of motion; a hydraulic cylinder having a retraction limit position and an extension limit position; means for sensing a position of the hydraulic cylinder; means for controlling fluid flow to and from the hydraulic cylinder; and means (1) for receiving the command signal, (2) for receiving the sensor signal, and (3) for commanding the means for controlling; wherein the means for commanding is configured to (1) damp retraction of the cylinder near its retraction limit position, (2) damp extension of the cylinder near its extension limit position, and (3) automatically stop damping retraction and extension upon receipt of a damping cancellation signal from the input device.

The means for generating may include a member having a central neutral position that can be deflected into directions away from the neutral position. The damping cancellation signal from the input device may be a function of at least two specific and successive movements of the input device occurring within a predetermined period of time. The means for commanding may maintain an internal timer indicating the time between the occurrence of the at least two specific and successive movements. A first movement of the two movements may be a first reversal of an operator command and a second movement of the two movements may be a second reversal of an operator command. The cylinder may have a central range of positions between the extension limit position and the retraction limit position in which the damping cancellation signal provided by the means for generating does not cancel damping.

In accordance with a third aspect of the invention, an electronic controller configured to damp the extension of a hydraulic cylinder in a work vehicle is provided, the work vehicle including a hydraulic cylinder having a retraction limit position and an extension limit position, a means for sensing a position of the hydraulic cylinder, a valve coupled to the electronic controller for controlling fluid flow to and from the hydraulic cylinder, an operator input device coupled to the electronic controller for generating a command signal indicative of desired cylinder movement over the cylinder's entire range of motion, the electronic controller including: at least one digital microprocessor; at least one ROM memory coupled to the at least one digital microprocessor; wherein the at least one ROM memory includes instructions that direct the digital microprocessor to (1) damp retraction of the cylinder near its retraction limit position, (2) damp extension of the cylinder near its extension limit position, and (3) automatically stop damping retraction and extension upon receipt of a damping cancellation signal from the input device.

The ROM memory may include instructions directing the microprocessor to interpret at least two specific and successive movements of the input device occurring within a predetermined period of time as the damping cancellation signal. The ROM memory may include instructions commanding the digital microprocessor to maintain an internal timer indicating the time between the occurrence of the at least two specific and successive movements. The ROM memory may include instructions configured to interpret a first reversal of an operator command as a first movement of the two movements and a second reversal of an operator command as a second movement of the two movements.

BRIEF DESCRIPTION OF THE DRAWINGS

FIG. 1 is a side view of a work vehicle having an excavator (e.g. backhoe) implement and a loader implement that are movable by several hydraulic cylinders.

FIG. 2 is as an electrical and hydraulic schematic diagram of a typical cylinder of the cylinders used to move the implements of FIG. 1 and the electronic controller that controls the movement of the cylinders.

FIG. 3 is a schematic diagram of the electronic controller of the circuit of FIG. 2.

DETAILED DESCRIPTION OF THE PREFERRED EMBODIMENTS

Referring now to FIG. 1, a work vehicle 100 is shown, comprising a tractor 102 which is coupled to two implements 104, 106. The vehicle is a loader-backhoe, and the implements include a backhoe (or excavator) attachment and a loader attachment.

Loader attachment 104 includes left and right loader arms (only the right loader arm 108 shown) disposed on either side of the vehicle, a bucket 110 coupled to and between the forwardly extending ends of the loader arms, left and right loader arm cylinders (only the right cylinder 112 is shown) configured to raise and lower the loader arms, and left and right bucket cylinders (only the right bucket cylinder 114 is shown) configured to tilt the bucket.

The backhoe attachment 106 includes a boom swing tower 116 pivotally coupled to the chassis 123 of the tractor to rotate about a substantially vertical axis with respect to the chassis, a boom 118 pivotally coupled to one end of tower 116 to pivot about a substantially vertical axis with respect to the boom swing tower, a dipper 120 having one end pivotally coupled to the other end of tower 116 to pivot about a substantially vertical axis with respect to the boom, and a bucket 121 having one end pivotally coupled to the other end of dipper 120 to pivot about a substantially vertical axis with respect to the dipper.

The backhoe 106 also includes boom swing cylinders 122 coupled between the chassis 123 of the tractor 102 and the swing tower 116 to pivot the swing tower with respect to the tractor. Backhoe 106 also includes boom lift cylinder 124 coupled between tower 116 and boom 118 to pivot the boom with respect to tower 116. Backhoe 106 also includes a dipper cylinder 126 pivotally coupled between boom 118 and dipper 120 to pivot the dipper with respect to boom 118. Backhoe 106 also includes a bucket cylinder 128 pivotally coupled between the bucket and dipper 120 to pivot the bucket with respect to the dipper.

Hydraulic cylinders 112, 114, 122, 124, 126, 128 are electronically damped or cushioned. As each cylinder approaches its limits of travel, both full extension and full retraction, an electronic controller 132 reduces the flow rate of hydraulic fluid to and from the cylinders. This reduction in flow rate is configured to reduce the speed of the cylinder, and hence reduce the speed of the implement to which it is attached. This reduction in speed occurs just as the cylinder and implement approach their extreme limits of movement, causing the cylinder and implement to slow to a halt without banging as they reach their stops.

FIG. 2 illustrates an electronic control circuit 130 including the electronic controller 132 that controls the flow of hydraulic fluid to the cylinders 112, 114, 122, 124, 126 and 128. For ease of illustration, only one of these cylinders is shown in FIG. 2: boom swing cylinder 122. It should be understood, however, that electronic control circuit 130 is identically coupled to the other cylinders in the same manner and controls the operation of those cylinders in the same manner as described above regarding boom swing cylinder 122.

Referring now to FIG. 2, a hydraulic cylinder configured to move an implement, here exemplified as boom swing cylinder 122, is coupled to two mechanical members that are pivotally coupled one to the other. These members include swing tower 116 and chassis 123 of tractor 102. When hydraulic cylinder 122 extends it pivots swing tower 116 with respect to chassis 123 in a first direction. When hydraulic cylinder 122 retracts, it pivots swing tower 116 with respect to chassis 123 in the opposite direction.

An electronic control circuit 130 is coupled to control valve 138 (1) to control the flow of hydraulic fluid to and from cylinder 122, and (2) to selectively damp and undamp the flow of hydraulic fluid to and from the cylinder.

Electronic control circuit 130 includes an electronic controller 132, an operator input device 134 coupled to electronic controller 132, and a cylinder position sensor 136. Circuit 130 is coupled to control valve 138 to damp and undamp the flow of hydraulic fluid to and from cylinder 122.

Electronic controller 132 is preferably a digital microprocessor-based controller. Controller 132 is shown in more detail in FIG. 3. Electronic controller 132 receives cylinder position signals from cylinder position sensor 136, and receives operator position and speed commands from operator input device 134.

Based upon these signals, controller 132 calculates the desired movement of cylinder 122 in response to the operator commands and generates a corresponding valve control signal calculated to cause the desired movements of cylinder 122.

Control valve 138 is a bidirectional proportional control valve. It includes electrical coils 140, 142 configured to drive the valve to its various positions. The valve is coupled to both an extend port 144 and a retract port 146 of cylinder 122, and configured to simultaneously supply one port with hydraulic fluid at the same time it exhausts fluid from the other port.

Valve 138 is further coupled to a source of hydraulic fluid under pressure 148, and to a reservoir (or tank) 150 that is configured to receive hydraulic fluid exhausted from cylinder 122.

By alternately energizing coils 140, 142, controller 132 can move valve 138 to any position in its range of positions and to correspondingly generate a wide variety of hydraulic fluid flow rates for fluid flow in both directions. Controller 132 is configured to vary the flow rate and direction of fluid flow through the valve by modulating the electrical current applied to the coils. The more current controller 132 applies to coil 140, the more valve 138 moves toward Position A, and the faster the rate at which cylinder 122 extends. Similarly, the more current controller 132 applies to coil 142, the more valve 138 moves toward Position B, and the faster the rate at which cylinder 122 retracts. When controller 132 applies no current to either coil, the valve returns to a neutral position, Position C, in which no hydraulic fluid flows through the valve, and cylinder 122 is held stationary.

In the preferred embodiment, as shown here, valve 138 is coupled directly to controller 132. In an alternative embodiment, two or more valves may be substituted for the single valve 138. One such valve may control flow in one direction to cylinder 122 and another valve may control flow in another direction to cylinder 122. One or more pilot actuators may be coupled to valve 138 in place of the coils. Electrically operated pilot valves may be coupled to those pilot actuators, the pilot valves being further coupled to controller 132. Selection between these and other equivalent alternative arrangements are within the capabilities of one skilled in the art.

Operator input device 134 generates an electrical signal proportional to the degree of deflection of control member 144. To signal movement of cylinder 122, the operator grasps control member 144 and manipulates it from a spring loaded neutral position in one of two opposing directions. To extend hydraulic cylinder 122, the operator moves control member 144 in one direction (A) away from neutral. To retract hydraulic cylinder 122 the operator moves control member 144 in the opposite direction (B) from neutral. The speed at which the cylinder moves is proportional to the amount of deflection of control member 144 from the neutral position. Thus, by moving control member 144 in different directions and in different amounts, the operator signals both speed of movement and direction of movement with the same device. Controller 132 is configured to respond to these varying signals and to generate a corresponding valve control signal.

Operator input device 134 may generate an analog signal or a digital signal. Device 134 may include a digital shaft encoder that generates a series of pulses indicating movement of member 144. It may also include a variable resistor or potentiometer that generates an electrical signal indicating the movement of member 144. Device 134 may also include circuits that receives signals from member 144 and provide a stream of digital numeric values indicative of the position of member 144 to controller 132.

Several operator input devices 134 (not shown) are coupled to controller 132 to provide signals for the other cylinders 112, 114, 124, 126, 128 that control movement of implements 104, 106. For convenience of illustration, however, FIG. 2 shows only a single cylinder 122 and a single operator input device 134. Thus, each cylinder of the backhoe and loader attachments is associated with its own corresponding operator input device 134.

Alternatively, operator input device 134 may be used to operate other cylinders in addition to cylinder 122. To provide this additional capability, alternative operator input device 134 may be configured for movement in additional directions. Movement in these other direction's generates additional signals indicating the desired direction and movement of other cylinder or cylinders shown in FIG. 1.

For example, operator input device 134 may be a joystick that generates signals corresponding to movement in two orthogonal directions, with signals generated by movement in one direction controlling movement of one cylinder and signals generated by movement in another direction controlling movement of another cylinder. A single operator input device 134 can thereby independently command movement of two different cylinders in vehicle 100 and to independently select both a damped and an undamped mode of operation for each of those cylinders.

Cylinder position sensor 136 provides a signal indicative of the position of cylinder 122 and provides it to controller 132. Controller 132, in turn, uses the position of the cylinder to calculate the appropriate valve command signal in light of the operator commands that controller 132 receives from operator input device 134.

In the preferred embodiment, position sensor 136 is a radar unit that senses the position of the rod and cylinder 122. It does this by reflecting a electromagnetic or sound signal off the rod. As the rod moves back-and-forth inside the cylinder, the amount of time required for a radar signal to travel the length of the cylinder and valves off the rod changes. Sensor 136 senses this difference in time and transmits a signal indicating the position of the cylinder (e.g. the position of the rod within the cylinder) to controller 132.

An alternative position sensor 136 may be used that is coupled to or responsive to movement of a different structure. For example, cylinder position sensor 136 may include a variable resistor or potentiometer that is coupled between two structures that are moved with respect to each other by the cylinder. Since cylinder 122 in the illustrated example of FIG. 2 is a boom swing cylinder, sensor 136 may be coupled between chassis 123 and swing tower 116 to sense the relative pivotal position of these two structures. The signal generated by this alternate sensor is proportional to the position of cylinder 122, and therefore indicates the position of cylinder 122. Other devices, such as capacitance detectors responsive, for example, to the presence of the rod; linear transducers responsive, for example, to the changing length of the cylinder; and optical sensors responsive, for example, to changing light levels caused by the cylinder changing in length, may also be used as sensor 136. Sensor 136 may also comprise a switch or switches that are responsive to the cylinder position, and more particularly, to the cylinder position at both ends of the cylinder stroke. In a preferred configuration, the switches have two states and change from one state to another state when the cylinder enters the two end regions of its stroke. Thus, a change in switch state indicates that the cylinder has entered an end region. The switches are thus configured to generate a signal indicative of cylinder position.

Controller 132 may also use position sensor 136 to perform other functions. Controller 132, for example, may use signals from sensor 136 to coordinate the raising and lowering of the loader bucket and loader arms.

FIG. 3 shows the construction of controller 132. Controller 132 includes a CPU 146, RAM 148, ROM 150, I/O circuit 152, communications circuit 154, and communications bus 156 which interconnects each of the foregoing components.

CPU (central processing unit) 146 is a digital processor, configured to receive digital instructions stored in ROM 150 and to execute them thereby controlling the operation of the entire system.

RAM (random access memory) 148 is provided to store working data it is stored and retrieved by CPU 146 as it executes its program.

ROM (read-only memory) 150 stores the digital instructions that are executed by CPU 146. These instructions indicate to CPU 146 how it should interpret the various operator commands from device 134 and how it should responsively signal valve 138.

I/O (input/output) circuit 152 includes driver circuits and signal conditioning circuits that match the level of incoming signals from input device 134 and the cylinder position sensor 136 to inputs of controller 132, and match the level of outgoing signals to the signal levels required by coils 140, 142. I/O circuit 152 may include the accounts circuits, amplifier circuits, and other well-known sub-circuits to perform this signal level matching and conditioning. I/O circuit 152 is coupled to input device 134, valve 138, and cylinder position sensor Communications circuit 154 is coupled to CPU 146 over bus 156 to communicate the status of the system to other similarly configured controllers 132 in vehicle 100. In an alternative configuration, a plurality of controllers 132 is provided, each controlling the different cylinder or cylinders of vehicle 100. In this case, communications circuit 154 would communicate the position of its cylinders and the position of its operator input device to other controllers 132 in the system. In this manner, the multiple controllers 132 of the alternative configuration can coordinate the operation of their corresponding cylinders. Similarly, communications circuit 154 is coupled to an operator display (not shown) that is configured to indicate the status of controller 132, the cylinders to which it is coupled, and the position of operator input device 134.

Bus 156 is a standard data/address/control bus that permits the components of controller 132 to communicate with each other.

Operation of the System

In the discussion below we say that the "system" performs certain functions. The system described herein is controlled by controller 132, whose behaviors are controlled by instructions stored in ROM memory 150. The same functions can nonetheless be performed by alternative devices, including analog electrical circuitry, mechanical linkages or structures, pneumatic circuitry, or hydraulic circuitry. These can be used by themselves, or in combinations with other circuits of the different type in varying compositions to provide the same functions.

Controller 132 is programmed to respond to the position of cylinder 122 and to damp the movement of the cylinder as it approaches its extreme limits positions. An example such an arrangement can be found in US patent application publication No. 2004/0045289 A1. The '289 system is inadequate, however, since it provides no means for overriding the automatic damping and permitting the operator to abruptly stopped any of the cylinders of the vehicle. The present system, in contrast, permits the operator to override the automatic damping (i.e. the damped mode) and provide for undamped operation (i.e. the undamped mode). The process by which controller 132 overrides automatic damping is explained below.

When the operator moves the operator input device 134, controller 132 is configured to examine the signal from device 134 and calculate an appropriate valve command signal. Controller 132 then applies this signal to valve 138. When cylinder 122 is in a central range of positions, controller 132 generates a valve command signal proportional to the direction and degree of deflection of device 134.

Controller 132 extends cylinder 122 when the operator moves control member 144 in one direction from its central neutral position. Control 132 retracts cylinder 122 when the operator moves control member 144 in the opposite direction from its central neutral position. Controller 132 controls the speed at which cylinder 122 retracts or extends in proportion to the degree of deflection of member 144 from its central neutral position. Controller 132 determines that cylinder 122 is in the central range of positions by monitoring the cylinder position sensor.

When cylinder 122 is outside the central range of positions, and is near either full extension (i.e. its extension limit) or full retraction (i.e. its retraction limit), controller 132 is configured to drive valve 138 and hence moves cylinder 122 in a different manner. As the cylinder approaches either its extend or retract limits, controller 132 reduces the signal applied to valve 138 to slow the cylinder down. Controller 132 reduces the speed of extension and retraction as swing tower 116 approaches its left and right pivoting limits. When cylinder 116 and the swing tower reach either one of these limits, controller 132 is configured to slow cylinder movement and swing tower movement to a stop. Details of one method of providing this movement are described in publication No. 2004/0045289 A1.

During the damped mode of operation and when the cylinder is in these two end ranges of positions (on either side of the central range of positions) controller 132 reduces fluid flow to and from cylinder 122 linearly in proportion to the remaining distance before cylinder 122 reaches its limit. This linear downward ramping of flow rate is shown in the '289 publication. Alternatively, a different function of distance than a linear function can be used, such as a second order, third order or exponential function, for example. In another configuration, controller 132 can be configured to decrease the flow rate as a function of the time the cylinder is in one of its two end regions. This configuration is especially useful when a sensor such as a switch is used to indicate that the cylinder is in one of its end regions. The damping time in this configuration can be varied as a function of the speed of the cylinder as it enters an end region. For example, if the operator input device indicates the cylinder is traveling at a high rate of speed when it enters an end region, controller 132 can reduce the fluid flow rate to the cylinder more rapidly. In yet another alternative, controller 132 can be configured to determine the position of the cylinder by monitoring the position of the valve with a valve position sensor, or by monitoring the signal applied to the valve, which in a preferred embodiment is proportional to the valve opening, and thus is proportional to flow rate to the valve, and thus is proportional to valve speed.

Controller 132 is also configured to override this automatic damping when commanded by the operator. The operator desires damped motion as a general rule. Therefore, the damped mode of operation, described above, is the default mode of operation. When the vehicle is turned on and the operator manipulates input device 134, controller 132 damps the movement of cylinder 122 automatically.

To leave this damped mode of operation, the operator must manipulate input device 134 in a special manner in order to signal controller 132 that he wishes to leave the damped mode and enter an undamped mode of operation in which controller 132 does not slow cylinder movement 122 down as it approaches its full extension and full retraction positions.

The most common reason the operator wants to "turn off" the damped movement of cylinder 122 is because he is trying to shake something loose from the implement. In a typical case, something will be stuck to the bucket, such as mud, earth, or rock. Having swung the boom to one of its extreme limits, the operator wishes to empty the bucket but cannot, since controller 132 has damped the extension and retraction of cylinder 122, thereby preventing the operator from shaking the implement. Operators intuitively try to shake the implement by rapidly moving the control member 144 back-and-forth about the neutral position, first moving member 144 in one direction away from the central neutral position and then rapidly moving the member back in the other direction away from the central neutral position. The operators' typical expectation is that "shaking" the input device back-and-forth will cause the controlled cylinder (in this case boom swing cylinder 122) to similarly shake back-and-forth.

To provide this capability, controller 132 is configured to monitor the signal provided by control member 144 and the signal provided by sensor 136 and to automatically switch to an undamped mode of operation when cylinder 122 is fully extended (or retracted), is moved away from full extension (or retraction), and then is again commanded to return to full extension (or retraction) a second time, all within a first predetermined interval of time. This first predetermined interval of time is preferably one second.

The first time cylinder 122 is fully extended (or retracted) damping is "on" and controller 132 eases cylinder 122 until it reaches its full extension (or retraction). If the operator in quickly moves member 144 in the opposite direction, controller 132 will responsively move cylinder 122 away from its fully extended (or retracted) position. If the operator again reverses the direction of member 144 to command cylinder 122 to again completely extend (or completely retract), his intention to "bang" the implement is clear. Controller 132 maintains an internal timer that permits it to sense whether this second reversal of commanded direction occurred within a predetermined short time interval (preferably of one second) of the first approach to the full extension (or retraction) position. Since this second extension (or retraction) occurs within the short time interval, controller 132 does not damp motion of cylinder 122—it does not reduce the flow rate of hydraulic fluid to cylinder 122—by reducing the valve signal using the linear flow reduction method described above. Instead, it applies a valve signal to valve 138 having the same magnitude (i.e. having the same relation to the position of member 144) as the valve signal controller 132 applies when cylinder 122 is in the undamped central range of cylinder positions.

Controller 132 is configured to continue operating in its undamped mode of operation for so long as the operator keeps reversing the commanded direction of movement of cylinder 122 within a second predetermined interval of time. This second time interval is preferably one second.

When the operator delays more than one second before commanding cylinder 122 to reverse direction (e.g. by moving member 144 through its neutral position), controller 132 senses this delay and automatically switches to the damped mode of operation. In the damped mode of operation, as described above, controller 132 automatically decelerates cylinder 122 whenever the operator enters the two end regions of the cylinder's travel.

In sum, controller 132 turns off cylinder cushioning when the operator repeatedly tries to hit the stop the cylinder cushioning is active the first time the stop is approached, but not for repeated approaches to the stop within the predetermined short period of time. This to bury elimination of damping is performed by measuring the time since last cylinder damping was performed. If this time a short, cylinder damping is not performed. The timer is not activated in the region where cylinder damping is performed.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown.

For example, in the preferred embodiment controller 132 decelerates the cylinder linearly as it approaches its two extreme positions. Controller 132 may alternatively decelerate the cylinders in a nonlinear manner. As another example, sensor 136 may include a switch or switches to indicate the cylinder is entering its end regions of travel adjacent to its fully extended and fully retracted stops. Controller 132 can be configured to sense the cylinder's entry into these end regions, and to progressively damp the motion of the cylinder as it approaches its stops. Controller 132 can calculate the speed at which the cylinder is traveling as it enters the end regions, determine how much time is available for damping at that speed before the cylinder hits its stops, and then to apply an appropriate amount of damping to effectively cushion the cylinder's stop. The faster the cylinder is traveling as it enters the end regions, the faster controller 132 reduces the speed of the cylinder.

I claim:

1. A system for damping the extension and retraction of a hydraulic cylinder of the work vehicle at the ends of the cylinder's stroke, the system comprising:

a manually operable operator input device configured to generate a command signal indicative of desired direction of cylinder movement and speed of cylinder movement for movement over the cylinder's entire range of motion;

a hydraulic cylinder having a retraction limit position and an extension limit position;

a sensor configured to generate a signal indicative of hydraulic cylinder position;

a valve coupled to the cylinder to control flow rate of hydraulic fluid to and from the cylinder; and an electronic controller that is coupled to the operator input device to receive the input device signal, wherein the controller is coupled to the sensor to receive the sensor signal and is coupled to the valve to command valve opening and closing;

wherein the controller is configured to (1) damp retraction of the cylinder near its retraction limit position, (2) damp extension of the cylinder near its extension limit position, and (3) automatically stop damping retraction and extension upon receipt of a damping cancellation signal from the input device.

2. The system of claim 1, wherein the operator input device includes a member having a central neutral position that can be deflected into directions away from the neutral position.

3. The system of claim 1, wherein the damping cancellation signal from the input device is a function of at least two specific and successive movements of the input device occurring within a predetermined period of time.

4. The system of claim 3, wherein the controller maintains an internal timer indicating the time between the occurrence of the at least two specific and successive movements.

5. The system of claim 4, wherein a first movement of the two movements is a first reversal of an operator command and a second movement of the two movements is a second reversal of an operator command.

6. The system of claim 1, wherein the cylinder has a central range of positions between the extension limit position and the retraction limit position in which the damping cancellation signal provided by the input device does not cancel damping.

7. A system for damping the extension and retraction of a hydraulic cylinder of the work vehicle at the ends of the cylinder's stroke, the system comprising:

means for generating a command signal indicative of desired cylinder movement direction and cylinder movement rate over the cylinder's entire range of motion;

a hydraulic cylinder having a retraction limit position and an extension limit position;

means for sensing a position of the hydraulic cylinder;

means for controlling fluid flow to and from the hydraulic cylinder; and means (1) for receiving the command signal, (2) for receiving the sensor signal, and (3) for commanding the means for controlling;

wherein the means for commanding is configured to (1) damp retraction of the cylinder near its retraction limit position, (2) damp extension of the cylinder near its extension limit position, and (3) automatically stop damping retraction and extension upon receipt of a damping cancellation signal from the input device.

8. The system of claim 7, wherein the means for generating includes a member having a central neutral position that can be deflected into directions away from the neutral position.

9. The system of claim 7, wherein the damping cancellation signal from the input device is a function of at least two specific and successive movements of the input device occurring within a predetermined period of time.

10. The system of claim 9, wherein the means for commanding maintains an internal timer indicating the time between the occurrence of the at least two specific and successive movements.

11. The system of claim 10, wherein a first movement of the two movements is a first reversal of an operator command and a second movement of the two movements is a second reversal of an operator command.

12. The system of claim 9, wherein the cylinder has a central range of positions between the extension limit position and the retraction limit position in which the damping cancellation signal provided by the means for generating does not cancel damping.

13. An electronic controller configured to damp the extension of a hydraulic cylinder in a work vehicle, the work vehicle including a hydraulic cylinder having a retraction limit position and an extension limit position, a means for sensing a position of the hydraulic cylinder, a valve coupled to the electronic controller for controlling fluid flow to and from the hydraulic cylinder, an operator input device coupled to the electronic controller for generating a command signal indicative of desired cylinder movement over the cylinder's entire range of motion, the electronic controller comprising:

at least one digital microprocessor; and at least one ROM memory coupled to the at least one digital microprocessor;

wherein the at least one ROM memory includes instructions that direct the digital microprocessor to (1) damp retraction of the cylinder near its retraction limit position, (2) damp extension of the cylinder near its extension limit position, and (3) automatically stop damping retraction and extension upon receipt of a damping cancellation signal from the input device.

14. The controller of claim 13, wherein the ROM memory includes instructions directing the microprocessor to interpret at least two specific and successive movements of the input device occurring within a predetermined period of time as the damping cancellation signal.

15. The controller of claim 14, wherein the ROM memory includes instructions commanding the digital microprocessor to maintain an internal timer indicating the time between the occurrence of the at least two specific and successive movements.

16. The controller of claim 14, wherein the ROM memory includes instructions configured to interpret a first reversal of an operator command as a first movement of the two movements and a second reversal of an operator command as a second movement of the two movements.

17. The controller of claim 13, wherein the at least one ROM memory includes instructions that direct the digital microprocessor to (4) automatically resume damping retraction and extension upon receipt of a damping resumption signal.

18. The controller of claim 17, wherein the at least one ROM memory includes instructions directing the microprocessor to interpret the passage of the second predetermined interval of time between two successive damping cancellation signals as the damping resumption signal.

19. The controller of claim 13, wherein the at least one ROM memory includes instructions that direct the digital microprocessor to linearly damp motion of the cylinder near its extension limit position and its retraction limit position.

* * * * *